US005336359A

United States Patent [19]

Pituch et al.

[11] Patent Number: 5,336,359

[45] Date of Patent: Aug. 9, 1994

[54] SYSTEM FOR APPLYING LITERATURE TO A WALL OF AN OBJECT

[75] Inventors: Thomas R. Pituch, Medford; Thomas M. Basgil, Cinnaminson, both of N.J.

[73] Assignee: Sancoa International Co., Mt. Laurel, N.J.

[21] Appl. No.: 949,100

[22] Filed: Sep. 21, 1992

Related U.S. Application Data

[63] Continuation of Ser. No. 648,702, Jan. 31, 1991, abandoned.

[51] Int. Cl.[5] ..... B65C 9/00

[52] U.S. Cl. ..... 156/568; 156/567; 156/DIG. 45; 156/542

[58] Field of Search ..... 156/566, 567, 521, 238, 156/361, 522, 542, 584, DIG. 25, DIG. 33, DIG. 45, 568; 271/110, 112, 119, 121

[56] References Cited

U.S. PATENT DOCUMENTS

| | | | |
|---|---|---|---|
| Re. 33,396 | 10/1990 | Voltmer et al. | 156/552 |
| Re. 33,579 | 4/1991 | Voltmer et al. | 156/552 |
| 4,230,516 | 10/1980 | Yamashita | 156/364 |
| 4,294,644 | 10/1981 | Anderson | 156/361 |
| 4,502,910 | 3/1985 | Voltmer et al. | 156/361 |
| 4,555,299 | 11/1985 | Voltmer et al. | 156/552 |
| 4,605,459 | 8/1986 | Voltmer et al. | 156/215 |
| 4,610,753 | 9/1986 | Voltmer et al. | 156/552 |
| 4,647,333 | 3/1987 | Voltmer et al. | 156/351 |
| 4,687,535 | 8/1987 | Voltmer | 156/361 |
| 4,842,660 | 6/1989 | Voltmer et al. | 156/64 |
| 4,852,014 | 7/1989 | Schwenzer | 364/479 |
| 4,853,063 | 8/1989 | Basgil et al. | 156/238 |

*Primary Examiner*—David A. Simmons
*Assistant Examiner*—J. Sells
*Attorney, Agent, or Firm*—Duane, Morris & Heckscher

[57] ABSTRACT

A system for applying literature to a wall of an object includes a hopper having an exit for dispensing literature one piece at a time and a rotatable member having a plurality of literature receiving areas disposed around the periphery thereof. Each literature receiving area receives one piece of literature from the exit. The member is positioned such that a portion of the periphery is in facing relationship with the exit of the hopper for allowing one of the literature receiving areas to be aligned with the exit. A servomotor rotates the rotatable member in a first direction such that the literature receiving areas pass by the exit one at a time to correspondingly receive a piece of literature from the exit of the hopper. A roller guides a web past a literature receiving area having a terminal piece of literature positioned thereon such that an adhesive coating on the web is in facing relationship with the terminal piece of literature. A pinch roller transfers the terminal piece of literature into adhering contact with the adhesive coating on the web. The web is then moved downstream to apply each piece of literature to an object.

1 Claim, 2 Drawing Sheets

SYSTEM FOR APPLYING LITERATURE TO A WALL OF AN OBJECT

This application is a continuation of co-pending U.S. Ser. No. 07/648,702, entitled SYSTEM FOR APPLYING LITERATURE TO A WALL OF AN OBJECT filed Jan. 31, 1991, now abandoned.

FIELD OF THE INVENTION

The present invention relates to packaging equipment and, more particularly, to a system for applying literature, such as folded matter, to the outside of a container.

BACKGROUND OF THE INVENTION

Packaging equipment is commonly used for the filling of containers, the closure of the containers, and the labeling of containers. Examples of containers in frequent use are the bottles or boxes found on the shelves in the marketplace. The bottles are used to package food and other items for both the home and in industry. Such packages are provided with labels to identify the contents of the package, as well as to provide instructions in the use of the material contained within the package.

A problem arises in that there are occasions wherein there is insufficient room on a package label to provide all of the necessary data and instructions on the use of the material contained within the package. For example, in the distribution of medicinal products, literature or outserts in the nature of a multi-folded paper is attached to the package, such multi-folded paper has adequate space to fully describe the material being packaged and/or its use. However, the securing of literature, such as the foregoing multi-folded paper or a brochure of bound sheets of paper, is not readily accomplished by the type of mechanism utilized for applying a simple, single layer label. The bulkiness of the literature and its tendency to open, necessitates the use of specially constructed equipment which can handle the folded or bound literature.

The known literature applying machines have a number of problems. Web breaks and adjustment of the literature stop pins create constant attendance. Tension of the web is critical because too much tension causes web breaks, while not enough tension may cause the web to sag. Further, removing the literature from a magazine hopper and placing it on the web in a consistent manner is another problem with the conventional literature applying machines. Such conventional literature applying machines use a reciprocating or rotary mechanism that takes the literature out of a hopper using a vacuum, turns the literature at an angle of 90° with respect to the web, and then releases the vacuum, thus adhering the literature to the web. However, this type of mechanism does not apply the literature to the web with consistent accuracy, and must be rebuilt frequently due to constant mechanical wear.

Literature may also be applied to containers using glue machines. The literature is removed from a hopper and placed on a rotary drum. The drum holds the literature by vacuum and is rotated to a station that applies glue to the back of the literature. The drum is then rotated to another station where the literature is applied directly onto a container. This method of applying a piece of literature to the container, however, is messy and inaccurate.

The present invention overcomes many of the disadvantages inherent in the above-described literature applying machines by providing a rotatable member which receives literature from a hopper and is rotated to a station that applies the literature to an adhesively coated web. The rotatable member of the present invention is rotated such that only a single piece of literature is received by each literature receiving area on the rotatable member.

SUMMARY OF THE INVENTION

Briefly stated, the present invention comprises a system for applying literature to a wall of an object. The system includes a hopper having an exit for dispensing literature one piece at a time and a rotatable member having a plurality of literature receiving areas disposed around the periphery thereof. Each literature receiving area receives one piece of literature from the exit. The member is positioned such that a portion of the periphery thereof is in facing relationship with the exit of the hopper for allowing one of the literature receiving areas to be aligned with the exit for receiving the one piece of dispensed literature. Drive means is drivingly associated with the member for rotating the member in a first direction such that the literature receiving areas pass by the exit one at a time to correspondingly receive a piece of literature from the exit of the hopper. A web having an adhesive coating on one side thereof is provided for receiving and carrying pieces of literature. Guide means guide the web past a literature receiving area of the member having a terminal piece of literature positioned thereon such that the adhesive coating on the web is in facing relationship with the terminal piece of literature. First transfer means transfers the terminal piece of literature from the literature receiving area having the terminal piece of literature therein into adhering contact with the adhesive coating on the web. Moving means moves the web past the first transfer means toward an object which is to receive a piece of literature. Second transfer means transfers a piece of literature from the web to the object. Means receive the web after removal of literature therefrom by the second transfer means.

BRIEF DESCRIPTION OF THE DRAWINGS

The foregoing summary, as well as the following detailed description of the preferred embodiment, will be better understood when read in conjunction with the appended drawings. For the purpose of illustrating the invention, there is shown in the drawings an embodiment which is presently preferred, it being understood, however, that the invention is not limited to the specific methods and instrumentalities disclosed. In the drawings.

DESCRIPTION OF PREFERRED EMBODIMENT

Figure 1:
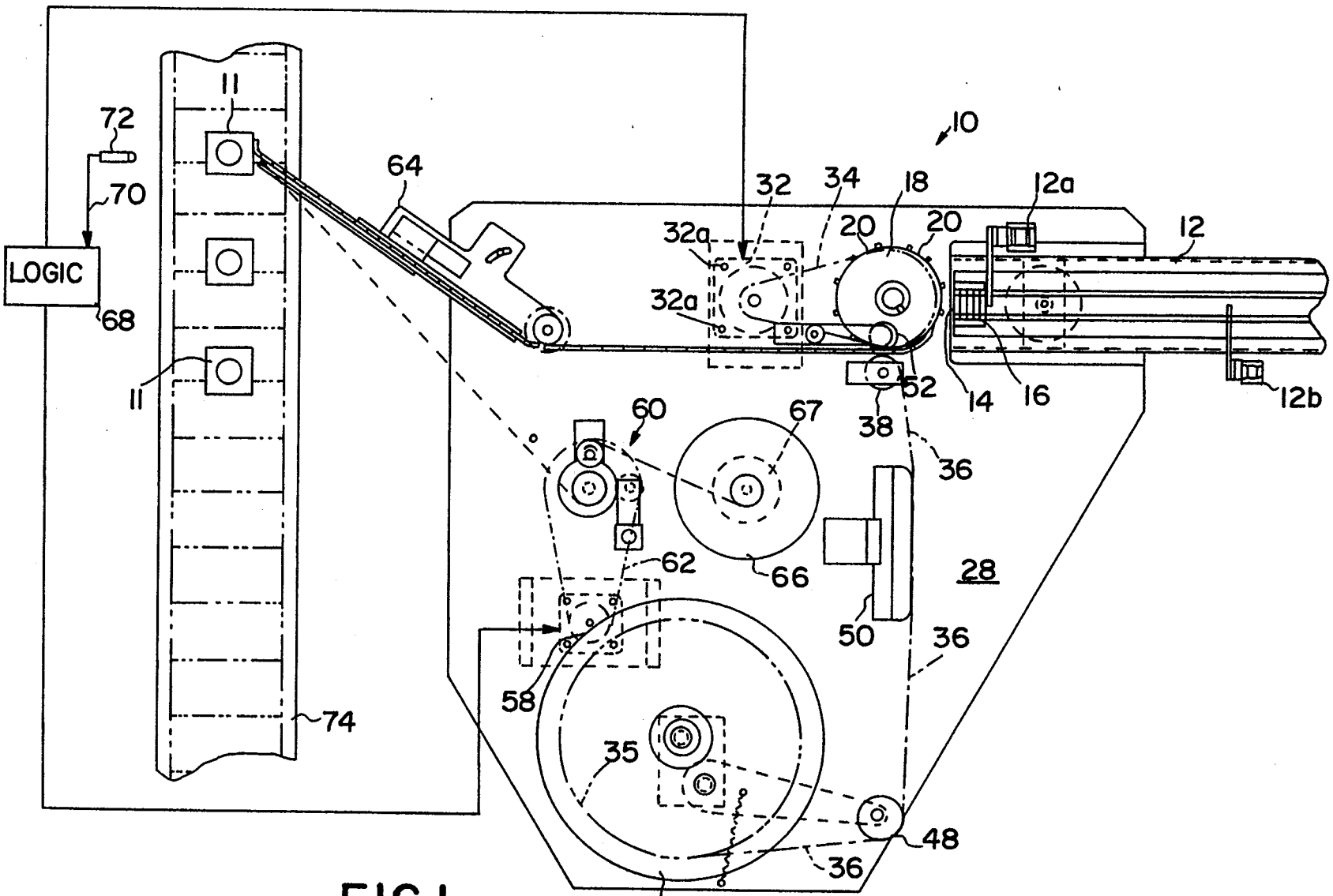
FIG. 1 is a top plan view of a system for applying literature to a wall of an object in accordance with the present invention.

Certain terminology is used in the following description for convenience only and is not limiting. The words "right", "left", "lower" and "upper" designate directions in the drawings to which reference is made. The words "inwardly" and "outwardly" refer to directions toward and away from, respectively, the geometric center of the system and designated parts thereof. The terminology includes the words above specifically mentioned, derivatives thereof and words of similar import.

Referring to the drawings, wherein like numerals indicate like elements throughout, there is shown in FIG. 1 a top plan view of a system, generally designated 10, for applying literature to a wall of an object 11 in accordance with the present invention. The object 11 is preferably a container having food, medicine or other items therein. The object 11 can be of any configuration so long as a surface is provided for receiving the literature 16, as is understood by those skilled in the art.

As shown in FIG. 1, the system 10 includes a hopper 12 having an exit 14 for dispensing literature 16 one piece at a time. As used herein, the term "literature" refers to multi-folded paper having adequate space to fully set forth information which is pertinent to the material being packaged. However, it is understood by those skilled in the art that the literature 16 could comprise a brochure of bound sheets of paper without departing from the spirit and scope of the invention.

In the present embodiment, it is preferred that the hopper 12 be comprised of an adjustable carriage which is used to control accurate positioning of the literature 16 for dispensing the same through the exit 14. Preferably, the hopper 12 is eight feet long and adjustable for various literature widths and sizes. The hopper 12 is provided with two pusher lifters 12*a* and 12*b* which maintain a constant force on the literature 16 in the direction of the exit 14. Each pusher lifter 12*a*, 12*b* preferably provides sufficient force to apply consistent pressure on the literature 16 until the hopper 12 dispenses all the literature 16 therein. The use of two pusher lifters allows nonstop continuous running of the system by pulling back one pusher lifter and loading the hopper 12 manually while the other pusher lifter is keeping the literature 16 moving toward the exit 14.

Figure 2:
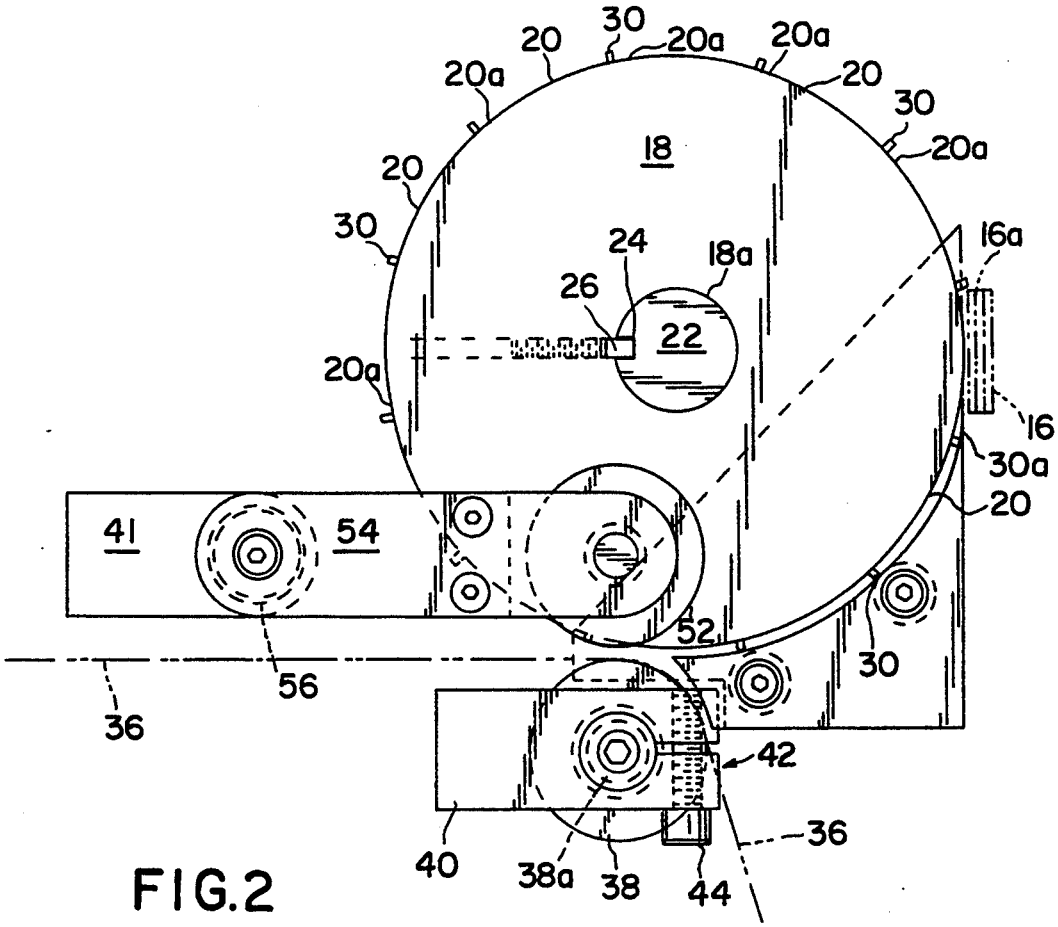
FIG. 2 is a greatly enlarged view of a portion of the system of FIG. 1 prior to operation.

Referring now to FIG. 2, the system 10 includes a rotatable member 18 having a plurality of literature receiving areas 20 disposed around the periphery thereof. The rotatable member 18 is preferably generally circular in plan view. Each literature receiving area 20 is preferably shaped for receiving one piece of literature 16 from the exit 14. That is, the literature receiving areas 20 are generally arcuate in plan view. A finger 30 extends outwardly from the periphery of the rotatable member 18 between each of the literature receiving areas 20 to define a notch 20*a* for extracting a piece of literature 16 from the exit 14, as described in more detail hereinafter. The rotatable member 18 is commonly referred to as a "star wheel".

Figure 3:
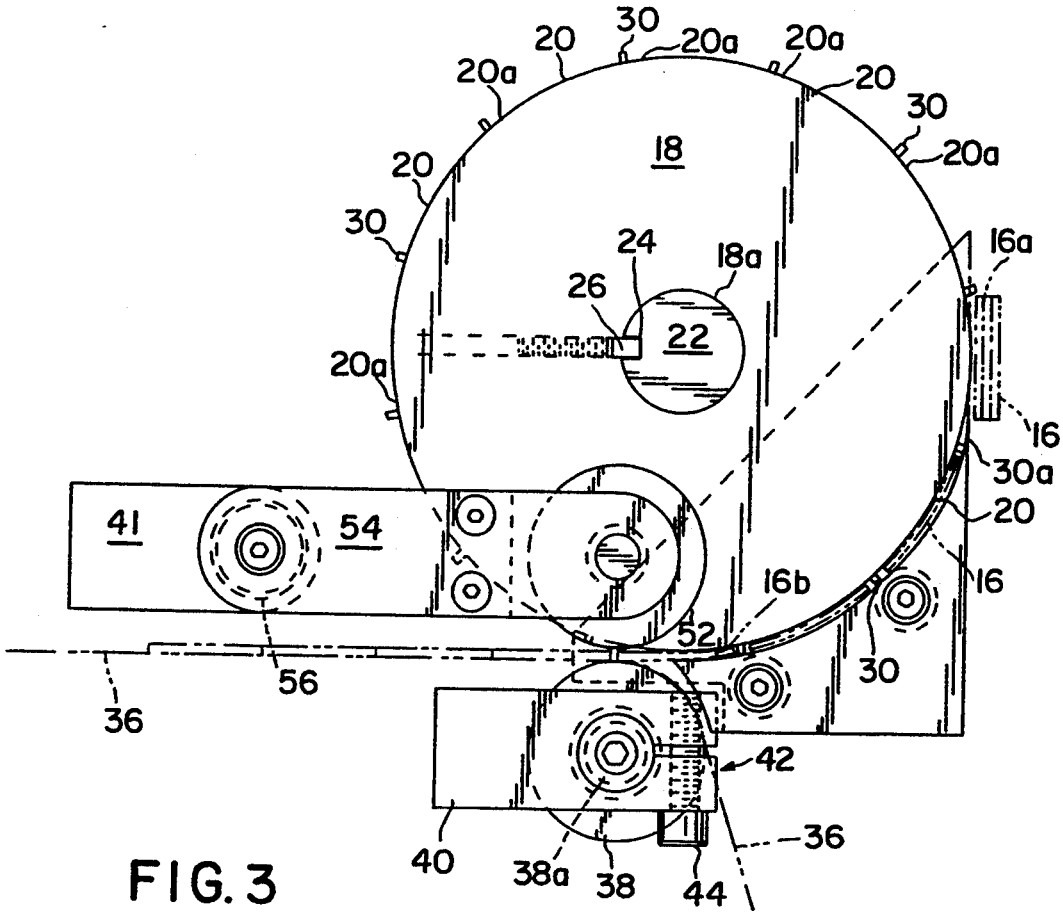
FIG. 3 is a greatly enlarged view of the same portion of the system shown in FIG. 2 showing the system in operation.

As best shown in FIG. 3, the rotatable member 18 is preferably positioned such that a portion of the periphery thereof is in facing relationship with the exit 14 of the hopper 12 for allowing one of the literature receiving areas 20 to be aligned with the exit 14 for receiving one piece of dispensed literature 16. In the present embodiment, it is preferred that the rotatable member 18 have twelve generally identical literature receiving areas 20 to thereby form a dodecagon. Each literature receiving area is sized to complimentarily receive a single piece of literature 16. As mentioned previously, the hopper 12 is adjustable for various literature widths. Similarly, the system 10 preferably includes a plurality of different sized rotatable members 18 (not shown) each having literature receiving areas of various sizes. For instance, a six pocket hexagon could be used for handling literature of relatively larger size. The rotatable member 18 is individually selected such that the size of the literature receiving areas 20 complements the literature 16 which is being applied to a particular container.

In the present embodiment, the rotatable member 18 has an axial height (not shown) which generally corresponds to the height of the literature 16. The rotatable member 18 is preferably comprised of two spaced generally identical planar members (only the lower member is shown). The members are preferably spaced a sufficient distance to receive the upper and lower portions of the literature 16. While it is preferred that the rotatable member 18 be comprised of two spaced generally planar members, it is understood that the rotatable member 18 could be of one piece construction which is hollow or solid.

It is preferred that the rotatable member 18 include a generally circular aperture 18*a* centrally disposed therethrough for releasably receiving a generally cylindrical complimentarily shaped drive member 22. The drive member 22 includes an axially extending groove 24 for releasably receiving a key 26 positioned within the rotatable member 18. The groove 24 holds the key 26 for allowing the rotatable member 18 to be readily exchanged for another, different sized rotatable member (not shown) for accommodating different sized literature.

As shown in FIG. 2, the rotatable member 18 includes a finger 30 extending generally radially outwardly from the periphery thereof between each of the literature receiving areas 20 for assisting in dispensing one piece of literature 16 into a literature receiving area 20 aligned with the exit 14. Each finger 20 preferably extends the entire axial height of the rotatable member 18 for allowing complete engagement with the literature 16. While it is preferred that the fingers 30 extend the entire height of the rotatable member 18, it is understood by those skilled in the art that the same can extend a portion thereof so long as the fingers 30 engage the literature 16. The fingers 30 are used for insuring that only a single piece of literature 16 is deposited into each literature receiving area 20, as described in more detail hereinafter.

As shown in FIG. 1, the hopper 12 and rotatable member 18 are mounted on a base 28 for support. The base 28 is preferably generally planar and includes a plurality of apertures and the like for securely receiving the various elements of the system 10, as described in more detail hereinafter. The base 28 can be mounted on any type of support structure, such as a table or legs (not shown) which may extend downwardly therefrom for supporting the base 28 above the ground or floor. It is understood by those skilled in the art that the base 28 does not form a pertinent part of the present invention and, therefore, further description thereof is omitted for convenience purposes only and is not limiting.

Referring now to FIG. 1, drive means are drivingly associated with the rotatable member 18 for rotating the rotatable member 18 in a first direction (i.e., clockwise when viewing FIGS. 2 and 3) such that the literature receiving areas 20 pass by the exit 14 one at a time to correspondingly receive a piece of literature 16 from the exit 14 of the hopper 12. In the present embodiment, it is preferred that the drive means be comprised of a servomotor 32 mounted beneath the base 28 by suitable fasteners, such as bolts 32*a*. An endless drive belt 34 is drivingly connected between the servomotor 32 and the drive member 22 in a standard manner such that the rotatable member 18 rotates therewith at a predetermined ratio.

Referring now to FIG. 2, in the present embodiment, it is preferred that the servomotor 32 rotate the rotatable member 18 in a second direction (i.e., counterclockwise) for removing a second piece of literature 16*a* which may have been inadvertently dispensed onto the literature receiving area 20 aligned with the exit 14 such that only a single piece of literature 16 is dispensed onto each literature receiving area 20. More particularly, it is preferred that the servomotor 32 be driven in a cyclic manner. That is, at the beginning of the cycle, one of the literature receiving areas 20 is aligned with the exit 14. The servomotor 32 then rotates the rotatable member 18 in the second direction (i.e., counterclockwise) approximately 10° to agitate the literature 16 in the hopper 12 by engaging the finger 30*a* with the same. The servomotor 32 is then driven in the first direction (i.e., clockwise) approximately 10° which realigns the previously aligned literature receiving area 20 with the exit 14. At this point, the servomotor 32 is rotated the required distance in the first direction to align the next or following literature receiving area 20 with the exit 14 to thereby receive another piece of literature 16.

Referring now to FIG. 1, the system 10 includes a web 36 having an adhesive coating on one side thereof for receiving and carrying pieces of literature 16. In the present embodiment, the web 36 is manufactured by 3M company as part number 920. The web 36 is available in varying widths and is selected in accordance with the width of the literature 16 which is to be dispensed by the system 10. The structure of the web 36 is well understood by those skilled in the outsetter art and, therefore, further description thereof is omitted for convenience purposes only and is not limiting.

Referring now to FIG. 3, the system 10 includes guide means for guiding the web 36 past a literature receiving area 20 of the rotatable member 18 having a terminal piece of literature 16*b* positioned thereon such that the adhesive coating on the web 36 is in facing relationship with the terminal piece of literature 16*b*. As used herein, the terminology "terminal piece of literature" refers to the piece of literature located on the literature receiving area 20 in facing relationship with the web 36.

In the present embodiment, the guide means is a roller 38 rotatably positioned proximate the literature receiving area 20 having the terminal piece of literature 16*b* therein. The roller 38 is rotatably mounted on a central shaft 38*a* which is preferably eccentrically mounted on a bracket 40 having an adjustment mechanism 42. The adjustment mechanism 42 allows the position of the roller 38 to be adjusted with respect to the rotatable member 18. The adjustment mechanism 42 is adjustable by rotating a bolt 44 to control the amount of crimping force (i.e., friction) applied to the central shaft 38*a* of the roller 38 to allow the central shaft 38*a* to eccentrically rotate with respect to the bracket 40 and thereby adjust the position of the roller 38. Once the roller 38 is in the desired position, the bolt 44 is tightened to lock the central shaft 38*a* and roller 38 in position. Preferably the roller 38 is positioned to provide a tangential transfer point for applying the literature 16 to the web 36.

Referring now to FIG. 1, the system 10 includes an unwind supply reel 46 which receives a roll 35 of web 36 and further includes a brake assembly (not shown). The unwind supply reel 46 further includes a spring loaded dancer arm roll assembly 48 to release the brake assembly (not shown) of the unwind supply reel 46. The dancer arm roller assembly 48 and brake assembly combine to prevent the unwind supply reel 36 from releasing too much web 36 thereby causing slack and hindering the overall performance of the system 10. The dancer arm roller assembly 48 and brake assembly also combine to enable the web 36 to move smoothly throughout the system 10. The web 36 is wound around the dancer arm roller assembly 48 to a vacuum holdback device 50. The vacuum holdback device 50 maintains web tension throughout the system 10 through the use of a Piab vacuum pump (not shown) which utilizes compressed air.

The unwind supply reel 46, brake assembly, dancer arm roller assembly 48 and vacuum holdback device 50 are well known to those skilled in the art and the details thereof do not form a pertinent part of the present invention. For purposes of completeness, U.S. Pat. Nos. 4,502,910; 4,555,299; 4,610,753; and 4,853,063 disclose outsert applying systems which include an unwind supply wheel, brake assembly, dancer arm roller assembly and vacuum holdback device which are hereby incorporated by reference. Accordingly, further description of the unwind supply reel 46, brake assembly, dancer arm roller assembly 48 and vacuum holdback device 50 is omitted for purposes of convenience only and is not limiting.

Referring now to FIG. 3, the web 36 moves from the vacuum holdback device 50 around the roller 38 such that a portion of the web 36 is in facing relationship with the terminal piece of literature 16*a*. The system 10 includes first transfer means for transferring the terminal piece of literature 16*a* from the literature receiving area 20 having the terminal piece of literature 16*a* therein into adhering contact with the adhesive coating on the web 36. In the present embodiment, it is preferred that the first transfer means be comprised of a pinch roller 52 rotatably and pivotally mounted on a second bracket 41. That is, the pinch roller 52 is rotatably mounted on a linkage member 54 which extends from and is pivotally mounted to the second bracket 41. The pinch roller 52 is preferably positioned between the two-spaced generally planar members of the rotatable member 18 for evenly engaging the literature 16. A spring 56 is positioned between the linkage member 54 and the bracket 40 for biasing the pinch roller 52 towards the roller 38 for forcing the terminal piece of literature 16*a* out of the literature receiving area 20 into adhering contact with the web 36.

Referring now to FIG. 1, the system 10 includes moving means for moving the web 36 past the first transfer means or pinch roller 52 toward an object 11 which is to receive a piece of the literature 16. In the present embodiment, the moving means is comprised of a servomotor 58 drivingly connected to a drive roller assembly 60. More particularly, the drive roller assembly 60 is drivingly connected to the servomotor 58 by an endless drive belt 62 interconnected therebetween. The servomotor 58 and endless drive belt 62 are preferably mounted beneath the base 28 in a manner similar to the servomotor 32 and endless belt 34 disclosed above in connection with the rotatable member 18.

After the web 36 moves past the roller 38 with the literature 16 attached thereto, a second transfer means transfers a piece of literature 16 from the web 36 to the object 11, as shown in FIG. 1. In the present embodiment, the second transfer means comprises a pivotally an adjustable dispensing edge 64 which applies literature 16 to the objects 11, one piece at a time. The adjustable dispensing edge 64 can be pivoted to different positions for accommodating different size objects 11 on the conveyor 74, as is understood by those skilled in the art. After the web 36 moves from the adjustable dispensing edge 64 towards the drive roller assembly 60, means are provided for receiving the web 36 after removal of literature 16 therefrom by the adjustable dispensing edge 64. In the present embodiment, the means is comprised of a rewind station 66 which is also driven by the servomotor 58 associated with the drive roller assembly 60 to rewind the web 36 around a roller 67.

The adjustable dispensing edge 64, drive roller assembly 60 and the rewind station 66 are well known to those skilled in the art and the details thereof do not form a pertinent part of the present invention. The adjustable dispensing edge 64, drive roller assembly 60 and the rewind station 66 are also disclosed in the patents discussed above which are incorporated by reference. Accordingly, further description of the drive roller assembly 60, adjustable dispensing edge 64 and rewind station 66 is not believed necessary, is omitted for purposes of convenience only and is not limiting.

Referring now to FIG. 1, the system 10 includes a logic unit 68, of well known design, which provides electronic signals for activating both of the servomotors 32 and 58. The logic unit 68 is activated by signals along line 70 from an object sensor 72. A signal from the object sensor 72 indicates that an object 11 has advanced to a position on the conveyor 74 for receiving a piece of literature 16. The logic unit 68 initiates operation of the system 10 in response to the signal from the object sensor 72 by advancing the web 36 when the object 11 arrives in position, and stops the operation of the system 10 by terminating the advancement of the web 36 when the piece of literature 16 is fully secured to the object 11.

It is preferred that the logic unit 68 be programmed so that the servomotors 32 and 58 be synchronized so that as the pinch roller 52 transfers the terminal piece of literature **16*b* into adhering contact with the adhesive coating on the web 36, the terminal piece of literature 16*b* and the web 36 are moving at generally the same velocity. This ensures a smooth transition between the terminal piece of literature 16*b* and the web 36**.

In the present embodiment, the object sensor 72 is comprised of a photoelectric eye which detects an object 11 on the conveyor 74. However, it is understood but those skilled in the art that other types of sensors, such as a mechanical trigger could be used to indicate the presence of an object in position to receive a piece of literature 16 from the adjustable dispensing edge 64, without departing from the spirit and scope of the invention. Moreover, the logic unit 68 is preferably comprised of a microprocessor having suitable programming for controlling the servomotors 32 and 58. The logic unit 68 and the associated object sensor 72 are well known elements understood by those in the art. Accordingly, further description of the logic unit 68 and object sensor 72 is believed unnecessary and, therefore, has been omitted and is not limiting.

To prepare the system 10 for operation, the servomotors 32 and 58 are actuated to apply the literature 16 along the web 36 between the adjustable dispensing edge 64 and the pinch roller 52, by repeating the sequence of operation discussed below. As such, literature 16 is located in the literature receiving areas 20 between the exit 14 and the pinch roller 52 and the terminal piece of literature **16*a* is at a position such that it is just touching the web 36 (see FIG. 3). At this point, the system 10 is ready to begin applying literature 16 to the objects 11**.

In the sequence of operation, the conveyor 74 is actuated until the object sensor 72 first senses an object 11 in the proper position for receiving a piece of literature 16 from the adjustable dispensing edge 64. When the object sensor 72 detects such an object 11, the logic unit 68 simultaneously instructs the servomotor 58 to drive the drive roller assembly 60 to advance the web 36 a distance equal to the width of a piece of literature and the servomotor 32 to rotate the rotatable member 18 in the first direction to peel one piece of literature from the hopper 12 by using the notch **20*a*. As the rotatable member 18 extracts a piece of literature 16 from the hopper 12, the adjustable dispensing edge 64 applies a piece of literature 16 to the object 11 and the pinch roller 52 smoothly transfers the terminal piece of literature 16*b* onto the web 36**.

After the terminal piece of literature **16*a* is completely applied to the web 36, the drive roller assembly 60 ceases rotating while the rotatable member 18 continues to rotate to close the distance between the pieces of literature 16 on the web 36 such that a distance of approximately 0.020 inches is yielded between each piece of literature. Once the terminal piece of literature 16*b* is applied to the web 36 the rotatable member 18 decelerates and stops after it has traveled one literature receiving area distance such that the next literature receiving area 20 is aligned with the exit 14. The servomotor 32 which drives the rotatable member 18 is then instructed to rotate 10° in the second direction (i.e., counterclockwise) to agitate the literature 16 in the hopper 12. That is, the fingers 30 between the literature receiving areas 20 on the periphery of the rotatable member 18 agitate, engage and force the piece of literature 16*a* positioned behind the piece of literature 16 (see FIG. 2) which is in facing relationship with the literature receiving area 20 aligned with the exit 14 back into the hopper 12, if necessary. The rotatable member is then rotated 10° in the first direction (i.e., clockwise) which repositions the literature receiving area 20 in correct alignment with the exit 14. At this point, the system 10** is ready for reinitiation of the cycle or sequence.

It is understood by those skilled in the art that the system 10 could include various fault conditions which assist in operating the system 10. For example, a sensor (not shown) could be provided for determining when the roll 35 of web 36 on the unwind supply reel 46 has reached the end of the web 36 to thereby stop the operation of the system 10. Further, the system 10 could include means (not shown) for detecting if the web 36 were to inadvertently sever to thereby allow the operator to splice the broken web together. In addition, the hopper 12 could include sensors (not shown) for alerting the operator that the hopper 12 must be supplied with more literature 16.

From the foregoing description, it can be seen that the present invention comprises a system 10 for applying literature 16 to a wall of an object 11. It will be recognized by those skilled in the art that changes may be made to the above-described embodiments of the invention without departing from the broad inventive concept thereof. It is understood, therefore, that this invention is not limited to the particular embodiments disclosed, but is intended to cover all modifications which are within the spirit and scope of the invention as defined by the appended claims.

We claim:

1. A system for applying literature to a wall of an object, said system comprising:

a hopper having an exit for dispensing literature one piece at a time;

a rotatable member having a plurality of literature receiving areas disposed around the periphery thereof, said rotatable member including a finger extending generally radially outwardly from the periphery thereof between each of the literature receiving areas, each literature receiving area for receiving one piece of literature from said exit, said member being positioned such that a portion of the periphery thereof is in facing relationship with said exit of said hopper for allowing one of said literature receiving areas to be aligned with said exit for receiving said one piece of dispensed literature;

drive means drivingly associated with said member for rotating said member in a first direction such that said literature receiving areas pass by said exit one at a time to correspondingly receive a piece of literature from said exit of said hopper, one of said fingers directly engaging and removing a piece of literature from said exit of said hopper as said member is rotated to dispense the piece of literature from said exit of said hopper into a literature receiving area aligned with said exit;

a web having an adhesive coating on one side thereof for receiving and carrying pieces of literature;

guide means for guiding said web past a literature receiving area of said member having a terminal piece of literature positioned thereon such that said adhesive coating on said web is in facing relationship with said terminal piece of literature;

first transfer means for transferring said terminal piece of literature from said literature receiving area having said terminal piece of literature therein into adhering contact with said adhesive coating on said web;

moving means for moving said web past said first transfer means toward an object which is to receive a piece of literature;

second transfer means for transferring a piece of literature from the web to the object, said drive means and said moving means being synchronized such that as said first transfer means transfers said terminal piece of literature into adhering contact with said adhesive coating on said web, said terminal piece of literature and said web are moving at generally the same velocity, said drive means further rotating said member in a second direction for agitating a second piece of literature inadvertently dispensed onto said one literature receiving area aligned with said exit from said one literature receiving area so as to remove said second piece of literature such that only a single piece of literature is dispensed onto each literature receiving area.

* * * * *